United States Patent [19]

Fujiwara et al.

[11] 4,129,445

[45] Dec. 12, 1978

[54] METAL IMAGE FORMATION PROCESS

[75] Inventors: Masato Fujiwara; Keiji Takeda; Masayoshi Tsuboi, all of Asaka, Japan

[73] Assignee: Fuji Photo Film Co., Ltd., Minami Ashigara, Japan

[21] Appl. No.: 881,945

[22] Filed: Feb. 28, 1978

Related U.S. Application Data

[63] Continuation of Ser. No. 731,957, Oct. 13, 1976, abandoned.

[30] Foreign Application Priority Data

Oct. 13, 1975 [JP] Japan ..... 50-123107

[51] Int. Cl.[2] ..... G03C 5/54; G03C 5/24

[52] U.S. Cl. ..... 96/29 R; 96/48 PD; 96/76 R

[58] Field of Search ..... 96/29 R, 29 L, 48 PD, 96/76 R

[56] References Cited

U.S. PATENT DOCUMENTS

| | | | |
|---|---|---|---|
| 3,512,972 | 5/1970 | Case | 96/48 PD |
| 3,656,952 | 4/1972 | Miller | 96/48 PD |
| 3,704,126 | 11/1972 | Land et al. | 96/29 R |
| 3,822,127 | 1/1974 | Tsuboi et al. | 96/29 R |

*Primary Examiner*—Won H. Louie, Jr.

*Attorney, Agent, or Firm*—Sughrue, Rothwell, Mion, Zinn and Macpeak

[57] ABSTRACT

A process for forming metal images of, e.g., copper at high sensitivity by imagewise depositing silver or silver ion on nuclei for physical development distributed on or in a support of an image forming photographic element or in a layer formed on the support of the photographic element to deactivate the physical developing activity of the active nuclei and then bringing the image forming element having the layer of the nuclei for physical developing which were not deactivated into contact with a physical developer containing a reducible heavy metal salt and a reducing agent to imagewise deposit the heavy metal, such as copper, on the remaining nuclei for physical development. A preferred embodiment comprises performing the above image forming process while depositing imagewise the silver or silver ion on the nuclei for physical development from the unexposed portions of an image-exposed silver halide photographic emulsion layer formed on the image forming photographic element by diffusion transfer.

9 Claims, No Drawings

METAL IMAGE FORMATION PROCESS

This application is a continuation of Ser. No. 731,957 filed on Oct. 13, 1976, abandoned.

BACKGROUND OF THE INVENTION

1. Field of the Invention

The present invention relates to a process of forming metal images and, more particularly, to a process of forming substantially non-silver or low-silver content metal images at high sensitivity.

2. Description of the Prior Art

An electrophotographic process, a process wherein a photopolymer is used as the photosensitive material, and a process wherein a diazo compound is used as the photosensitive material have hitherto been employed as a process of forming images at comparatively high sensitivity or speed without using silver halide as the photosensitive material. However, these conventional non-silver type photographic processes are inferior in sensitivity to the silver halide photographic process and hence it is impossible to substitute the silver halide photographic process for these non-silver type photographic processes. In addition to these conventional photographic processes, an attempt toward increasing the sensitivity in photographic image forming process by physical development has also been made.

A physical development is a photographic development wherein an intensification or a growth of the development nucleus is achieved by treating the development nucleus with a developer containing a reducible metal compound and a reducing agent. In physical development, substantially all parts of the metal in the visible images formed are produced by the selective reduction of metal ions supplied from a reducible metal compound in a developer. Thus, it can be said that physical development be essentially the same as the so-called non-electrode plating.

A physical development wherein a silver compound is employed as the nucleus for the physical development is known and with regard to materials other than silver compounds usable as nuclei for physical development, noble metals such as gold, platinum, and palladium are known but materials other than these noble metals are not very well known. For example, a physical development wherein a noble metal is employed as the nuclei for physical development is described in the specification of U.S. Pat. No. 3,719,490, in which the physical development is carried out using a photosensitive palladium compound. The process disclosed in the above U.S. Patent is actually a useful image forming process but since the photosensitive component employed in the process is a photosensitive palladium compound, other photosensitive elements based on other photosensitive components than the photosensitive palladium compound cannot be used in the process and, also, the sensitivity of the photosensitive elements used in the process is generally low since the sensitivity thereof is determined by the sensitivity of the photosensitive palladium compound.

On the other hand, a photosensitive gold compound and a photosensitive platinum compound are also employed as the photosensitive component in physical development but since these noble metal compounds also have low sensitivity just as the photosensitive palladium compound, it is impossible to use these noble metal compounds as the nuclei for physical development with a high sensitivity as is the situation with silver halide. On the other hand, silver does not act as nuclei for physical development to materials other than silver.

SUMMARY OF THE INVENTION

Various investigations have been made to find materials other than the above described noble metal compounds, which can be used as the useful nuclei for physical development, and as the result of these investigations, various materials capable of being used as active nuclei for physical development have now been discovered. It has also been found that nuclei for physical development with the materials thus found surprisingly lose their activity due to the action of a small amount of silver or silver ions. Based on this discovery highly sensitive and substantially non-silver type image forming process of this invention has been achieved.

An object of this invention is to provide an image forming process wherein photosensitive elements having active nuclei for physical development are used at high sensitivity.

Another object of this invention is to provide a process for deactivating active nuclei for physical development at high sensitivity.

Still another object of this invention is to provide a process for forming images by deactivating active nuclei for physical development at high sensitivity.

These and other objects of this invention will become apparent from the following descriptions of this invention.

That is, this invention provides an image forming process comprising, in succession, the steps of (1) imagewise depositing silver or silver ions on the surfaces of nuclei for physical development formed by a material capable of doping silver atoms or silver ions into the development nuclei by the action of light or heat, these nuclei for physical development being distributed in the nature of a layer in or on a support of an image forming photosensitive element or in a binder-containing layer formed on the support of the photosensitive element, whereby the physical developing activity of the nuclei for development is deactivated, and (2) bringing the nuclei for physical development imagewise remaining without being deactivated into contact with a physical developer containing a reducible metal salt and a reducing agent to form the image of the metal.

According to another embodiment of this invention, this invention further provides an image forming process as set forth above wherein step (1) is performed by silver ions transferred by diffusion from the unexposed portions of an imagewise exposed photosensitive silver halide emulsion layer by a diffusion transfer development.

DETAILED DESCRIPTION OF THE INVENTION

The material used as the nuclei for physical development in the process of this invention is (1) a material whose property is changed on contact with silver or silver ions, (2) a material whose property is changed upon irradiation with electromagnetic waves (e.g., having a wavelength ranging from that of $\gamma$-rays to about 600 nm, preferably about 250 nm to about 550 nm such as visible light, ultraviolet rays, etc.) or upon heating (e.g., about 150° C. to about 400° C., preferably 200° C. to 300° C., with the maximum temperature employable being determined not by any limitation due to the nature of this invention but rather based on the nature of the support which is used, with the thus employable temperature range for heating being in the range at which the support is neither transformed or degraded) after contact with silver or silver ion, or (3) a material which is, from a physicochemical standpoint, shielded from its surroundings by the action of silver or silver ion which is very quickly collected at the periphery or the surface portion of the material. Specific examples of materials which can be used as nuclei for physical development are materials in which silver or silver ion can be doped by the action of electromagnetic waves such as, for example, visible light, ultraviolet rays, etc., or by the action of heat and materials which can collect silver or silver ion on the surface portion thereof in a close contact relationship therewith. Further, in accordance with the present invention, the nuclei for physical development may be used as a combination of at least one of the former material and at least one of the latter material (the latter material will, hereinafter, be called "silver depositing material," for brevity).

Typical and suitable examples of the material which can be doped with silver ion or silver using electromagnetic waves are germanium, tellurium, and chalcogen compounds. The term "chalcogen compound" is used, in this specification, to describe a compound formed by the combination of chalcogen as described in "Material Properties of Chalcogen Glasses as Inorganic Polymers" in *Kagaku to Kogyo* (*Chemistry and Industry*), Vol. 23, 966–973 (1970) and in a report entitled "About Chalcogen Glass" in *Zairyo Kagaku* (*Material Chemistry*), Vol. 3, 116–126 (1966) and other element (e.g., Ge, Sn, Fe, As, Sb, Bi, etc.). Typical examples of chalcogen compounds which can be used in this invention are binary chalcogen compounds such as Ge-S series chalcogen compounds (e.g., $GeS_2$), Sn-S series chalcogen compounds (e.g., $SnS_2$), Fe-S series chalcogen compounds (e.g., $Fe_2S_3$), As-S series chalcogen compounds, As-Se series chalcogen compounds, As-Te series chalcogen compounds, S-Se series chalcogen compounds, Sb-Se series chalcogen compounds, Sb-Te series chalcogen compounds, Bi-S series chalcogen compounds, Bi-Se series chalcogen compounds, Bi-Te series chalcogen compounds, etc., and ternary chalcogen compounds such as As-S-Te series chalcogen compounds, As-Se-Te series chalcogen compounds, etc. Other examples of chalcogen compounds are the metal halides (e.g., CuI) and metal sulfides (e.g., CdS) as described in *Soviet Physics-Solid State,* Vol. 8, 451–452 (1966). Examples of the particularly useful chalcogen compounds among these materials are $SnS_2$, CdS, and $PbI_2$.

On the other hand, silver depositing materials which can be used in this invention include the materials as described in the specification of U.S. Pat. No. 2,774,667 and in A. Rott and E. Weyde, *Photographic Silver Halide Diffusion Processes,* pages 54–57 published in 1972 by the Focal Press Co. Typical examples of silver depositing materials are heavy metals such as zinc, mercury, cadmium, iron, chromium, nickel, tin, cobalt, copper, etc.; noble metals such as platinum, palladium, iridium, rhodium, ruthenium, silver, gold, etc.; light metals such as aluminum, etc.; the sulfides, selenides and tellurides of these metals; and germanium sulfide.

In this invention, the material used as the nucleus for physical development is distributed, in a plane (i.e., as a layer or in the nature of a layer), in or on the support of an image forming photosensitive element or in a binder-containing layer formed on the support. Only metal images that have a low optical density and thus cannot visually be distinguished are obtained when the physical developer is brought into contact with the nucleus for physical development and, in addition, in this case, the metal images obtained have a low mechanical strength and have a high electric resistance and low conductivity. More inconveniently, if the amount of the nucleus for physical development is too small (i.e., less than about 5 $mg/m^2$), sometimes the nucleus for physical development is dissolved by the physical developer when the physical developer is brought into contact with the nucleus for physical development. Also, where a process in which the nucleus for physical development is deactivated by a diffusion transfer process is employed, the silver images formed by the diffused silver ion have a low optical density.

On the other hand, if the amount of the nucleus for physical development is too large (i.e., more than about 2 $g/m^2$), the metal images obtained have a high optical density and can be visually distinguished clearly and, in addition, the metal images have a high mechanical strength, low electric resistance, and high conductivity. Also, where a process in which the nucleus for physical development is deactivated by diffusion transfer is employed, the silver images formed by the silver ion diffused have a high optical density. Furthermore, in this case, the optical density of the nucleus for physical development itself becomes much higher.

On considering these circumstances as stated above, the amount of the nucleus for physical development is in the range of from about 3 nm to about 500 nm, preferably in the range of from about 5 nm to about 200 nm in the thickness of the planar portion in which the nucleus for physical development exists.

Preferably the condition of the nuclei for physical development ranges from such a state that the nuclei for development are independent and yet very close to each other to such a state that the nuclei for development are in contact with each other. However, the nuclei for physical development exist, as a matter of course, in such a state that when the planar portion containing the nuclei for physical development is observed in the vertical direction to the planar portion, the nuclei for development are seen to overlap each other. This state is represented as an optical density ranging from about 0.03 to about 0.3, preferably from about 0.05 to about 0.15.

The deactivation method of the active nuclei for physical development (hereinafter, referred to as active nuclei), which is an important feature of this invention, is explained below. That is, the necessary condition for effecting the deactivation method of this invention is that silver or silver ion is ultimately brought into contact with the active nuclei to cause a reaction with the active site of the nucleus for physical development and to deactivate the active site or that the active site of the active nucleus is covered by silver or the active nucleus itself is completely shielded from the surroundings. The deactivation method for the active nucleus can be classified into three types. In the first type, silver is deposited on the surface of the active nucleus by vacuum deposition or sputtering. In the second type, the support of an image forming photosensitive element having the active nuclei is immersed in a physical developer for silver. In the third type, silver from the unexposed portion of an imagewise exposed photosensitive silver halide emulsion layer of an image forming photosensitive element is used.

It is difficult, among these method types, to imagewise deactivate the active nuclei by the first and second deactivation methods and even if it is possible, it is impossible to perform the deactivation at high sensitivity. Furthermore, the deactivation by the first and second methods cannot be used in combination with light patterns. However, these difficulties can be overcome by utilizing the deactivation method by the third method. In the image forming process of this invention, the deactivation by the third method is utilized. That is, the deactivation method is utilized in this invention in such a manner that an imagewise exposed photosensitive silver halide emulsion layer is closely superposed on a layer containing active nuclei and a silver salt diffusion transfer type development (e.g., as described in U.S. Pat. Nos. 3,043,690, 3,019,109, 3,065,075, etc.) is applied to the assembly. For the purpose, it is preferred that the active nuclei utilized in this invention be made of a silver depositing material capable of acting as the nucleus for development for the silver salt diffusion transfer type development or have on the surfaces thereof the silver depositing material as stated above.

The principle and technique of a silver salt diffusion transfer process using photosensitive silver halide emulsions are known as described in A. Rott and E. Weyde, *Photographic Silver Halide Diffusion Processes,* supra. Thus, attempts to deposit silver on the active nuclei using the above described diffusion transfer process have now been made and were successful. In this case, it has surprisingly been found that the active nuclei employed in this invention lose their physical developing activity due to the silver or the silver ion transferred from the photosensitive silver halide emulsion layer or layers. By what mechanism the deactivation corresponding to each of the above described three methods of deactivation occurs has not yet been clarified but the result obtained is that the active nuclei were deactivated by a small amount of silver halide. This makes it possible to imagewise deactivate the active nuclei with a small amount of silver using the silver salt diffusion transfer process and to obtain metal images by treating the remaining active nuclei with a physical developer and further provides novel high-sensitive low-silver content type silver salt photographic materials, which are important features of this invention. In addition, the term "low-silver type silver salt photographic material" is used herein to describe a silver salt photographic material in which the amount of silver salt contained in the photosensitive composition or compositions of the photographic material per unit area is smaller than about 1/10 on a molar basis of the amount for silver halide or silver halides contained in a unit area of a conventional silver halide photographic material of the type to be processed by chemical development.

Another important feature of this invention is explained below. That is, a feature of this invention is obtained where active nuclei having the property of doping therein silver by the action of light (electromagnetic radiation) or heat are used. When the deactivation process of this invention, that is, the silver salt diffusion transfer process is employed, the active nuclei are deactivated at the portions into which silver diffuses (the nucleus for development thus deactivated is hereinafter called "deactivated nucleus", for brevity) but after subjecting the remaining active nuclei to physical development, the silver transferred by diffusion remains in situ at the non-image portions as fog. Therefore, it is very important to improve the contrast of images for observation to remove the silver therefrom. Thus, subjecting the image forming photographic material thus processed by physical development in this invention to overall exposure of ultraviolet rays or heating for a short period (e.g., about 1 second to about 60 minutes, preferably 5 seconds to 30 seconds) of time was attempted. As shown in, for example, *Bulletin of the Chemical Society of Japan,* Vol. 44, 1173 (1971), silver is doped in lead iodide by light exposure to reduce the optical density due to the silver and as a result of the above attempts, it has now been confirmed that this phenomenon is also observed in the active nuclei in this invention. That is, the optical density of the non-image portions is greatly reduced by light exposure. Thus, the process of this invention includes as a result a process of removing fog, which is a remarkable feature of the process of this invention.

Moreover, even if the active nucleus itself does not have the property of doping silver, images of a heavy metal other than silver having a high optical density than that of the images formed by silver can be obtained if the active nucleus is sufficiently active to a physical developer since the effective amount of silver used in the photosensitive silver halide emulsion layer in this invention can be about 1/10 on a molar basis of the amount of silver used in a conventional silver salt diffusion transfer process. Examples of materials providing such an active nucleus are heavy metals such as gold, platinum, iridium, silver, palladium, etc., and the active nuclei of these heavy metals have usually a high physical developing activity. However, it is more preferred, in general, to use these active nuclei in combination with another active nucleus having the property of doping silver by the action of light or heat.

The image forming process of this invention will be explained in greater detail below. The image forming photographic element or unit used in this invention has at least a layer containing the above described nuclei for physical development formed in or on a support and at least a layer containing a photosensitive silver halide emulsion formed in or on a support. These layers can be formed in or on the same support or can be formed in or on different supports, respectively.

The support used in this invention can be suitably selected according to the embodiment of this invention employed. For example, depending on end-use purposes, rigid supports such as glass plates, metal plates or foils, porcelains, etc., or flexible supports can be used. Typical examples of flexible supports which can be used in this invention are cellulose nitrate films, cellulose acetate films, cellulose acetate butyrate films, cellulose acetate propionate films, polystyrene films, polyvinyl chloride films, polyethylene terephthalate films, polycarbonate films, laminates of these films, thin glass films, papers, synthetic films, etc. Papers coated or laminated with baryta, titanium oxide, or an $\alpha$-olefin polymer, in particular, a polymer of an $\alpha$-olefin having 2 to 10 carbon atoms, such as polyethylene, polypropylene, ethylene-butene copolymers, etc.; and plastic films the surfaces of which are matted or roughened to improve the adhesive property to other polymers and to improve the printability as described in Japanese Patent Publication No. 19,068/72 can be also used as the support in this invention.

Specific examples of rigid supports are glasses such as quartz glass, soda lime glass, potssium lime glass, lead glass, alkali glass, barium glass, borosilicate glass, etc.; natural materials such as quartz, sapphire, etc.; cermet;

metals and alloys such as aluminum, copper, zinc, iron, chromium, nickel, brass, stainless steels, etc.; and laminates of two or more layers of these materials.

Also, depending on the end-use purposes of the photographic materials used in this invention, a transparent support or an opaque support is employed. Furthermore, in employing a transparent support, not only a colorless transparent support but also a transparent support colored with dyes or pigments can be used as employed conventionally as X-ray films or as described in *J. SMPTE,* 67, 296 (1958).

Opaque supports which can be used in this invention include not only papers which are originally opaque as well as opaque films prepared by incorporating dyes or pigments such as titanium oxide in transparent films, plastic films surface-treated in the manner described in, for example, Japanese Patent Publication No. 19,068/72, and papers and plastic films which are rendered completely light shielding by the incorporation of carbon black, dyes, etc.

The support can be coated with an interlayer or surface-treated with a corona discharge, flame treatment, UV radiation or the surface hydrolyzed with an alkaline solution for facilitating the formation of a water-permeable layer thereon. Furthermore, the surface of the support used in this invention can be roughened for facilitating the application of a silver depositing material onto the surface by vacuum deposition or sputtering.

The material for the nucleus for physical development is applied on the support by, for example, a method comprising preparing an image receiving element by coating a composition containing a silver depositing material on a support as is conventionally employed in the silver salt diffusion transfer photograhic system, a method as disclosed in Japanese Patent Application (OPI) No. 33,620/72 (British Pat. No. 1,336,277) wherein the surface layer of the support is brought into contact with a solution containing a silver salt depositing material to impregnate the silver depositing material into the surface layer of the support from a solution, or a method wherein a silver depositing material is applied onto the surface of a support by vacuum deposition or cathode sputtering or spraying under an inert atmosphere. Furthermore, a water-permeable layer may be formed on a support for protecting thereby the active nuclei present in or on the support and increasing the mechanical strength of the support (e.g., as disclosed in Japanese Patent Application (OPI) No. 33,620/72 (British Pat. No. 1,336,277)).

The binder used for forming a layer of a composition containing nuclei for physical development or a water-permeable layer applied on a support can be appropriately selected from materials generally known to form water-permeable layers or films, such as, for example, gelatin, polyvinyl alcohol, hydrolyzed cellulose esters, polyethylene oxide, carboxymethyl cellulose, cross-linked gelatin, cross-linked polyvinyl alcohol, etc.

The deactivation process for nuclei for physical development used in the silver salt diffusion transfer process in this invention is as follows: In the process, silver or silver ion is supplied onto the active nuclei having a property of depositing thereon silver from a photosensitive silver halide emulsion layer formed on the same support as that bearing thereon the layer of the active nuclei or a support different from the support bearing thereon the active nuclei. The principle and technique of the diffusion transfer of the photosensitive silver halide are known as described in, for example, *Photographic Silver Halide Diffusion Processes,* supra. Typical examples of embodiments of processing the silver salt diffusion transfer image-receiving element are shown below:

1. A support having a layer of the nuclei for physical development in this invention is superposed on an imagewise exposed silver halide photographic element (negative element) so that the active nucleus layer faces the photosensitive silver halide emulsion layer, a processing composition is spread between both layers and after a definite period of time (e.g., about 2 seconds to 60 seconds, preferably 5 seconds to 30 seconds), the image-receiving element is separated from the negative material, whereby positive silver images are formed on the image-receiving element.

2. A multilayer one-sheet type diffusion transfer photographic unit or element comprising a support having formed thereon a layer of nuclei for physical development together with silver halide photosensitive emulsion layers, etc., is imagewise exposed and then processed using a processing composition for a definite period of time (e.g., about 2 seconds to 60 seconds, preferably 5 seconds to 30 seconds) to dissolve off or not dissolve off the emulsion layers and the white pigment-containing layer.

The liquid processing composition used in the process of this invention usually contains a thickener capable of forming a high viscosity solution, such as cellulose derivatives (e.g., carboxymethyl cellulose, ethyl cellulose, hydroxyethly cellulose, methyl cellulose, hydropropyl cellulose, etc.), vinyl polymers (e.g., polyvinyl alcohol, etc.), acrylic acid polymers (e.g., polymethacrylic acid, polyacrylic acid, etc.), and inorganic polymers; inorganic silver complex salt forming agents such as thiosulfates (e.g., sodium thiosulfate, potassium thiosulfate, ammonium thiosulfate, etc.), and thiocyanates (e.g., sodium thiocyanate, potassium thiocyanate, ammonium thiocyanate, etc.); cyclic imides such as uracil, barbituric acid, urazole, hydantoin, etc., (e.g., as described in U.S. Pat. No. 2,857,274); basic nitrogen-containing compounds such as ethylamine, ethanolamine, etc., (e.g., as described in U.S. Pat. No. 3,343,958); developing agents such as hydroquinone, hydroquinone derivatives (e.g., toluhydroquinone, t-butylhydroquinone, phenylhydroquinone, etc.), p-aminophenol, p-aminophenol derivatives (e.g., N-methyl-p-aminophenol, trimethyl-p-aminophenol, etc.), hydroxylamine, hydroxylamine derivatives (e.g., N-dimethoxyethyl hydroxylamine, N-diethoxyethyl hydroxylamine, diethylhydroxylamine, etc.), 3-pyrazolidone, 3-pyrazolidone derivatives (e.g., 1-phenyl-3-pyrazolidone, etc.), and ascorbic acid; inorganic alkalis such as sodium carbonate, sodium hydroxide, lithium hydroxide, potassium hydroxide, ammonia, etc., or amines such as ethanolamine, diethanolamine, etc. As the case may be, a part or all of the silver halide solvent, the thickener, the developing agent, and the alkali can be incorporated in a silver halide photographic element or an element having the layer of nuclei for physical development. Suitable examples of diffusion transfer developing solutions are disclosed in U.S. Pat. Nos. 3,043,690, 3,019,109, 3,065,075, etc.

On the other hand, the silver halide photosensitive emulsion layer contains a dispersion or emulsion of silver halide such as silver chloride, silver bromide, silver iodide, etc., in an appropriate protective colloid such as a natural polymer (e.g., gelatin, collodion, agaragar, etc.) or a synthetic polymer (e.g., polyvinyl alcohol, etc.).

Thus, when the silver salt diffusion transfer development is carried out after imagewise exposure according to a typical embodiment, the silver ion in the unexposed portion of the silver halide emulsion layer is transferred by diffusion onto the layer containing the active nuclei and is reduced to silver on the active nuclei, whereby the active nuclei are deactivated there. Therefore, the sensitivity in the process of this invention is determined by whether the silver halide exposed in the silver halide emulsion layer is developed in the emulsion layer or transferred therefrom to the layer of the active nuclei. That is, the sensitivity of the process is determined by the sensitivity of the silver halide emulsion employed. As is well known, a high sensitivity can be easily attained using silver halide emulsions for silver salt diffusion transfer and thus the active nuclei in this invention can be deactivated at high sensitivity.

As is clear from the aforesaid description, the step of deactivating the active nuclei in the process of this invention is one of the important features of this invention. Another important feature in the step is that the amount of silver or silver halide in the photosensitive silver halide emulsion used in quite small as compared with the amount of silver (about 0.5 to 3.0 $g/m^2$) used in a conventional silver salt diffusion transfer process for providing silver images. According to data developed in this invention, the amount of silver in the photosensitive silver halide emulsion layer depends on the kind of the active nucleus employed in this invention but the amount of silver present is preferably in the range of about 0.005 to about 0.5 $g/m^2$, preferably 0.01 to 0.25 $g/m^2$. Of course, a silver halide emulsion layer containing more than about 0.5 $g/m^2$ of silver can be used in this invention.

The physical development used in the process of this invention is explained in greater detail below. After imagewise deactivating the nuclei for physical development by silver or silver ion according to the deactivation process of this invention, the element having the layer of the active nuclei is immersed in a physical developer, whereby a metal is deposited on the active nuclei remaining without being deactivated in the layer to provide metal images. In addition, in the process of this invention, the portions containing the active nuclei correspond to the portions exposed at imagewise exposure and the portions containing deactivated nuclei correspond to the unexposed portions. The active nucleus acts as a catalyst center or nucleus for depositing the reducible heavy metal salt in the physical developer and the reducible heavy metal salt acts as a source of metal for intensifying the catalyst center. The heavy metal latent image formed must be self catalytic. That is, the heavy metal latent image must have a catalytic action capable of reducing and depositing the heavy metal ion from the physical developer. The heavy metals having such a property are metals belonging to Group VIII of the Periodic Table, such as nickel, cobalt, and iron, metals belonging to Group VIb, such as chromium and metals belonging to Group Ib such as copper.

The reducible heavy metal ion is added to a physical developer as a water-soluble salt of the metal. Examples of appropriate water-soluble reducible heavy metal salts used for the purpose are heavy metal halides such as cobalt (II) chloride, cobalt (II) iodide, iron (II) bromide, iron (II) chloride, chromium (III) bromide, chromium (III) iodide, copper (II) chloride, etc.; heavy metal sulfates such as nickel sulfate, iron (II) sulfate, cobalt (II) sulfate, chromium (III) sulfate, copper (II) sulfate, etc.; heavy metal nitrates such as nickel nitrate, iron (II) nitrate, cobalt (II) nitrate, chromium (III) nitrate, copper (II) nitrate, etc.; and heavy metal salts of organic acids such as iron (II) acetate, cobalt (II) acetate, chromium (III) acetate, copper (II) formate, etc. The physical developer can be prepared using one or more of these reducing heavy metal ions.

The physical developer used in this invention contains further a complexing agent for the reducible heavy metal ion or ions. The complexing agent for the reducing heavy metal ion in the physical developer must combine with the heavy metal ion so that the heavy metal ion is not spontaneously reduced in the presence of a reducing agent. However, the complexing agent must not combine with the heavy metal ion too strongly to reduce the heavy metal ion with the reducing agent in the presence of the catalyst component. Any complexing agent meeting these requirements can be used in the process of this invention. Preferred examples of complexing agents which can be used in this invention are organic carboxylic acids such as monocarboxylic acids, dicarboxylic acids, hydroxycarboxylic acids, etc. Specific examples of these carboxylic acids are malic acid, lactic acid, succinic acid, citric acid, aspartic acid, glycolic acid, tartaric acid, ethylenediaminetetraacetic acid, gluconic acid, saccharic acid, quinic acid, etc. The complexing agents can be used individually or as a mixture of two or more.

The physical developer can further contain various additives such as, for example, an acid or base for controlling the pH, a buffer, a preservative, a thickening agent, a whitening agent, etc., for improving the storability of the developer, facilitating the workability, and also improving the quality of the images formed. Furthermore, by adding a surface active agent such as an alkali metal salt of sulfated fatty acid (e.g., sodium dodecyl sufate) to the physical developer, the development speed can be increased and thus the period of time required for finishing the development can be shortened.

The ratio of each component to be added to the physical developer can be varied depending on the purpose. The concentration of the reducible heavy metal salt is about 0.01 to about 1 mol per liter of the physical developer although the upper limit of the heavy metal salt will differ to some extent depending on the solubility of the heavy metal salt used. A preferred concentration of the heavy metal salt is 0.1 to 0.3 mol per liter of the physical developer. The relative ratio of the reducible heavy metal salt to the complexing agent depends upon the nature of the heavy metal salt and of the complexing agent used. Generally speaking, the complexing agent must be added to the physical developer in an amount sufficient for reducing the tendency of the metal ion to be reduced before using the physical developer by combination with the reducible heavy metal ion. The proportion of the complexing agent is usually from about 0.2 to about 10 mols, preferably 0.5 to 5 mols, per mol of the reducible heavy metal.

A reducing agent is added to the physical developer at a proportion of from about 0.01 to 5 mols, preferably 0.02 to 3 mols, per mol of the reducible heavy metal salt present in the developer. To most effectively prolong the life of the physical developer at least 1 equivalent of the reducing agent must be added per equivalent of the reducible heavy metal salt present.

The physical developer can be used over a broad range of pH's. However, the physical developer preferably is maintained at an alkalinity of a pH of about 8 to 11, preferably a pH of 8.5 to 9.5. However, if it is advantageous to conduct the photographic process using the physical developer under acid conditions, the physical developer can be used under conditions of a pH of 3. The physical developer can be maintained at an appropriate pH value by adding thereto a suitable base such as ammonium hydroxide and sodium hydroxide together with, if necessary, a suitable buffer such as sodium carbonate and sodium hydrogen carbonate. Other materials which can be used for adjusting the pH of the physical developer by controlling the pH value thereof can be suitably selected by any one skilled in the art. A suitable temperature range at which the physical developer can be used ranges from about 10° to 100° C., preferably 15° to 90° C., with, of course, as is well known to one skilled in the art, the temperature range which can be employed will be dependent upon the kind of heavy metal used. For example, when the heavy metal ion is $Cu^{2+}$, a preferred temperature ranges from about 15° to 50° C., and when the heavy metal ion is $Ni^{2+}$, a preferred range is from about 50° to 90° C. A suitable time for immersion ranges from about 1 second to 60 minutes, preferably 5 seconds to 10 minutes.

When the support having the photographic layers in this invention is immersed in the physical developer having the above described property, the above described heavy metal deposits on the active nucleus portions but the heavy metal does not deposit on the deactivated nucleus portions. Thus, imagewise heavy metal images are formed but the deactivated nucleus portions retain the silver transferred from the silver halide emulsion layer due to the silver salt diffusion transfer process, which gives rise to fog. The optical density of the silver image is determined by the amount of silver required for deactivating the active nuclei. If the density of silver corresponding to fog is large, the fog is reduced as follows. That is, after the physical development processing, the layer of the nuclei for physical development is uniformly irradiated with ultraviolet rays or heated (e.g., for about 1 second to 30 minutes, preferably 5 seconds to 5 minutes), the heavy metal images at the active nucleus portions are not changed but the silver in the deactivated nucleus portions is doped in the deactivated nuclei by light exposure, whereby the silver images at the deactivated nucleus portions vanish and at the same time the optical density thereof is greatly reduced. By this procedure, it becomes possible to cause the images at the deactivated nucleus portions to disappear, that is, the fog portions.

As is clear from the explanations as stated above, the image forming process of this invention is an image forming process with a quite high sensitivity and is a process capable of providing stable metal images at low cost as compared with conventionally disclosed processes. Furthermore, the present invention provides a process for forming non-silver metal images at high sensitivity. As a matter of course, the process of this invention can be used for the preparation of conductive images used for duplication, making printed circuits, etc., as is the situation with other physical development processes.

The invention will further be explained below in greater detail. Unless otherwise indicated, all parts, percents, ratios and the like are by weight and all procedures were conducted at room temperature (about 20°–30° C.) and atmospheric pressure.

EXAMPLE 1

After applying a corona discharge treatment to a transparent polyethylene terephthalate film having a thickness of 100 μm to render the surface hydrophilic, the film thereafter was set in a vacuum deposition apparatus and then a chalcogen compound having a composition $GeS_2$ was vacuum deposited thereon at a distance of 40 cm from the surface thereof. The amount of the chalcogen compound thus deposited was such that an optical density of 0.1 was obtained. Thereafter, a coating solution having the following composition was applied to the surface with the chalcogen compound vacuum deposited thereon as a water-permeable layer at a thickness of 0.5 μm after drying followed by drying.

| | |
|---|---|
| Formaldehyde (10% aq. soln.) | 3.4 ml |
| Gelatin | 5.0 g |
| Saponin | 0.2 g |
| Water | 1,000 ml |

The pH of the composition was adjusted to 7.5 by adding thereto a 0.1 N aqueous sodium hydroxide solution.

Thus, an image receiving element comprising a support having a layer containing nuclei for physical development was produced.

On the other hand, a cellulose triacetate film (having a thickness of 155 μm) the surface of which had been subjected to a hydrophilic treatment was coated with a conventional silver chloride-gelatin photographic emulsion at a dry thickness of 1 μm, the support having the silver halide emulsion layer was immersed in an aqueous solution of 10% by weight formaldehyde for 1 minute for hardening, and then dried to provide a negative photographic element. The amount of silver in the silver halide emulsion layer thus formed was 0.05 g/m$^2$. In addition, the ratio of the silver to the gelatin in the emulsion layer was 0.3.

The negative photographic element thus prepared was imagewise exposed through a negative original to a light source of 1,000 lux for 0.5 second. Then, the silver halide emulsion layer of the photographic element thus exposed was superposed on the image receiving layer previously prepared and a processing solution having the following composition was spread between both elements to perform diffusion transfer development.

| | |
|---|---|
| Sodium Sulfite (anhydrous) | 70 g |
| Carboxymethyl Cellulose | 25 g |
| Hydroquinone | 20 g |
| 1-Phenyl-3-pyrazolidone | 1 g |
| Sodium Thiosulfate (anhydrous) | 10 g |
| Potassium Bromide | 1.5 g |
| Potassium Hydroxide | 15 g |
| Water to make | 1 l |

After maintaining the elements in intimate contact for about 10 seconds, both elements were separated from each other.

The optical density of the silver images obtained at the silver image receiving side (i.e., the side of the nucleus for physical development) subtracting the fog optical density therefrom was 0.6. Then, the support having the silver image receiving layer was immersed in a physical developer having the following composition for 30 seconds at 25° C.

| | | |
|---|---|---|
| $CuSO_4 . 5H_2O$ | 10 | g |
| NaOH | 17 | g |
| $K_2CO_3$ | 4 | g |
| Sodium Potassium L-Tartarate | 50 | g |
| EDTA | 0.7 | g |
| Distilled Water | 900 | ml |

Before using the above described developer, 100 ml of a 38% formaldehyde aqueous solution was added to the developer with stirring. The physical development can also be carried out using a commercially available chemical copper plating bath "Naviganth G. S." (made by Schering A. G., West Germany).

The optical density of the positive copper image thus obtained was 1.6 and the copper image was clearly distinguishable from the negative silver image. The support having the image-bearing layer was subjected to overall exposure to a high pressure mercury lamp (ORC Jett Printer 2,000 made by Ohk Seisakusho) of 3 kw for 10 minutes at a distance of 65 cm. Thus, the silver image disappeared and the optical density of the silver image at these silver image portions was reduced to 0.15, whereby a clearer copper image was obtained.

EXAMPLE 2

By following the same procedure as described in Example 1 except that a physical developer having the following composition was used at 75° C. for 3 minutes, a nickel image was obtained.

| | |
|---|---|
| $NiCl_2 . 6H_2O$ | 30 g |
| Sodium Citrate | 88 g |
| $NaH_2PO_2$ | 20 g |
| $NH_4Cl$ | 30 g |
| Ammonia (25% aq. soln.) | 25 g |

The optical density of the nickel image obtained was 2.0 and the nickel image was clearly distinguishable from the silver image. The support having the image-bearing layer was then subjected to overall exposure using the same mercury lamp as in Example 1 for 10 minutes, whereby the optical density of the silver image portion was reduced to 0.15 and a clear nickel image was obtained.

EXAMPLE 3

By following the same procedures as described in Example 1, a chalcogen compound having a composition $SnS_2$ was formed on a polyethylene terephthalate film by vacuum deposition and in this case the amount of the deposition was such that an optical density of 0.3 was obtained. Thereafter, a water-permeable layer having the same composition as described in Example 1 was formed on the vacuum deposited layer to provide an image receiving element.

By following the same procedure, a negative photographic element was prepared except that the amount of silver in the silver chloride emulsion layer was adjusted to 0.1 g/m$^2$. The photographic element thus prepared was imagewise exposed and developed. The optical density of the silver image obtained in the silver image receiving element was 0.8 after subtracting the fog density. The support having the image receiving layer was immersed in a physical developer having the same composition as described in Example 1 for 1 minute at 25° C., whereby the optical density of the copper image thus obtained was 1.2. When the support having the image-bearing layer was uniformly exposed to a mercury lamp for 15 minutes as in Example 1, the optical density of the silver image portions was reduced to 0.4.

EXAMPLE 4

By following the same procedures as described in Example 1, a chalcogen compound having a composition CdS was vacuum deposited on a polyethylene terephthalate film and then a water-permeable layer was applied on the chalcogen layer to provide an image receiving element. Also, by following the same procedures as described in Example 1, a negative photographic element was prepared and then, the photographic material was exposed and developed as in Example 1. The amount of vacuum deposited CdS was such that an optical density of 0.1 was obtained and the silver amount in the silver chloride emulsion layer was 0.075 g/m$^2$. The optical density of the silver image in the image receiving element thus formed was 0.7.

The support having the image-receiving layer was immersed in a physical developer having the same composition as described in Example 1 for 30 minutes at 25° C. and the optical density of the copper image obtained was higher than 3.0. Then, when the support having the image receiving layer was further uniformly irradiated using a mercury lamp as in Example 1 for 30 minutes, the optical density of the silver image portions was reduced to 0.5.

EXAMPLE 5

After applying a chalcogen compound having a composition $GeS_2$ on a polyethylene terephthalate film by vacuum deposition as in Example 1, gold was further vacuum deposited thereon. In this case the optical density of $GeS_2$ was 0.1 and the optical density of the gold was 0.05. Then, as described in Example 1, a water-permeable layer was formed on the layer to provide an image receiving element. Also, by following the same procedures as described in Example 1, a negative photographic element was prepared (the amount of silver in the silver halide emulsion layer was 0.3 g/m$^2$).

Then, the negative photographic material was exposed and developed as described in Example 1. The optical density of the silver image obtained was 1.5. When the image receiving element having the silver image was immersed in a physical developer having the same composition as described in Example 1 for 30 seconds at 25° C., the optical density of the copper image obtained was higher than 3.0 and no copper image formed on the silver image portions. Then, when the image receiving layer having the copper image therein was uniformly exposed to a mercury lamp for 15 minutes as in Example 1, the optical density of the silver image on the copper image reduced to 0.5.

EXAMPLE 6

The procedure as in Example 1 was followed using a conventional silver bromide-gelatin photographic emulsion. In this case the amount of silver in the silver bromide emulsion layer was adjusted to 0.05 g/m$^2$. The optical density of the silver image at the silver image receiving side was 0.6 and the optical density of the copper image obtained by physical development was 1.6.

EXAMPLE 7

By following the same procedures as described in Example 1 using a silver iodobromide emulsion (containing 3 mol% silver iodide), the same result as in Example 6 was obtained.

EXAMPLE 8

On an image receiving element prepared in the same way as in Example 1 was applied directly an ordinary silver chloride emulsion followed by drying to form an emulsion layer of a thickness of 1 μm and then the assembly was immersed in an aqueous solution of 10% by weight formaldehdye for 1 minute to harden the silver halide emulsion layer, whereby a mono-sheet type photographic unit was obtained. In this case the silver amount in the silver chloride emulsion layer was adjusted to 0.05 g/m$^2$. The photographic unit was exposed to light of 1,000 lux for 0.5 second through a negative transparent image.

Thereafter, the assembly was subjected to a diffusion transfer development using a physical developer having the composition as described in Example 1. After sufficient washing, the photographic unit was immersed in a physical developer having the same composition as described in Example 1 for 3 minutes at 24° C. to perform the physical development. In this case, the optical density of the silver image at the exposed portions was 0.5 and the optical density of the copper image at the unexposed portions was 1.3.

While the invention has been described in detail and with reference to specific embodiments thereof, it will be apparent to one skilled in the art that various changes and modifications can be made therein without departing from the spirit and scope thereof,.

What is claimed is:

1. A process for forming metal images which comprises:

imagewise inactivating an image receiving element containing physical development nuclei to intensification with a physical developer containing a salt of a reducible metal and a reducing agent by imagewise depositing silver on said physical development nuclei by diffusion transfer of silver ion from the unexposed portion of an imagewise exposed silver halide photographic element, said image receiving element comprising a support having vacuum deposited thereon or vacuum deposited on a layer on said support, nuclei for physical development selected from the group consisting of $GeS_2$, $SnS_2$, CdS and a combination of $GeS_2$ and gold, said silver ions being transferred in an effective amount to imagewise inactivating said nuclei for physical development;

and subsequently depositing said metal on said nuclei not deposited with said silver by contacting said image receiving element with said physical developer.

2. The process as set forth in claim 1, wherein said nuclei for physical development are distributed on said support or in a layer on said support such that the nuclei are independent yet very close to each other or in contact with each other.

3. The process as set forth in claim 1, wherein said salt of a reducible metal is a salt of a metal belonging to Group VIII of the Periodic Table, a metal belonging to Group IVb of the Periodic Table or a metal belonging to Group Ib of the Periodic Table.

4. The process as set forth in claim 3, wherein said salt of a reducible metal is a salt of nickel, cobalt, iron, chromium, or copper.

5. The process as set forth in claim 1, wherein said physical developer contains a complexing agent for the metal ion of the salt of said reducible metal.

6. The process as set forth in claim 5, wherein the concentration of said salt of a reducible metal in said physical developer ranges from about 0.01 to 1 mol per liter of said physical developer, wherein said reducing agent is present in said physical developer in a proportion of from about 0.01 to 5 mols per mol of said reducible heavy metal salt, wherein the proportion of the complexing agent ranges from about 0.2 to about 10 mols per mol of said salt of said reducible metal and wherein the pH of said physical developer ranges from about 8 to about 11.

7. The process of claim 1, wherein after depositing said metal on the nuclei not deposited with said silver, the photosensitive element is irradiated with ultraviolet light or heated to thereby reduce the fog caused by the silver at the inactive nuclei.

8. The process of claim 1 wherein said nucleii for physical development are present in an amount of from about 3 nm to about 500 nm in the thickness of the planar portion of said support or layer in which the nuclei for physical development exists and are distributed such that the optical density due to the nucleii is 0.03 to 0.3.

9. The process of claim 1 wherein the amount of silver in said photographic element is .005 to 0.5 g/m$^2$.

* * * * *